US008447052B2

(12) United States Patent
Lee et al.

(10) Patent No.: US 8,447,052 B2
(45) **Date of Patent: *May 21, 2013**

(54) ELECTRONIC DEVICE EMPLOYING SOUND PLATE SWITCHABLE BETWEEN STAND TYPE AND HANG TYPE

(75) Inventors: Gyeong-tae Lee, Uiwang-si (KR); Jong-bae Kim, Seoul (KR); Jong-in Jo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 185 days.

This patent is subject to a terminal disclaimer.

(21) Appl. No.: 13/019,364

(22) Filed: Feb. 2, 2011

(65) Prior Publication Data

US 2011/0188679 A1 Aug. 4, 2011

(30) Foreign Application Priority Data

Feb. 2, 2010 (KR) ..... 10-2010-0009640

(51) Int. Cl.
*H04R 25/00* (2006.01)

(52) U.S. Cl.
USPC ..... 381/152; 381/333; 381/388

(58) Field of Classification Search ..... 381/306, 381/333, 152, 388
See application file for complete search history.

(56) References Cited

U.S. PATENT DOCUMENTS 6,332,029 B1 * 12/2001 Azima et al. ..... 381/152
6,415,035 B1 * 7/2002 Shin et al. ..... 381/388

* cited by examiner

*Primary Examiner* — Suhan Ni
(74) *Attorney, Agent, or Firm* — Sughrue Mion, PLLC

(57) ABSTRACT

An electronic device includes a sound plate switchable between a stand type and a hang type. In the electronic device, the sound plate has a coupled structure movable between a first arrangement, in which the sound plate functions as a stand and a second arrangement wherein the sound plate is disposed at the rear of a main body as a hang type. In the first arrangement, the sound plate emits a sound through a slit provided in a side surface of the sound plate, and in the second arrangement, the sound plate emits sound through an opening in a front surface of the sound plate which is perpendicular to the side surface of the sound plate.

25 Claims, 21 Drawing Sheets

ELECTRONIC DEVICE EMPLOYING SOUND PLATE SWITCHABLE BETWEEN STAND TYPE AND HANG TYPE

CROSS-REFERENCE TO RELATED PATENT APPLICATION

This application claims the benefit of Korean Patent Application No. 10-2010-0009640, filed on Feb. 2, 2010, in the Korean Intellectual Property Office, the disclosure of which is incorporated herein in its entirety by reference.

BACKGROUND

1. Field

The present exemplary embodiments relate to an electronic device employing a flat sound plate, and more particularly, to an electronic device employing a sound plate switchable between a stand type and a hang type.

2. Description of the Related Art

With the development of flat display panel (FDP) technologies, electronic devices such as digital televisions (TVs) have become slimmer. Thus, acoustic devices having a structure suitable for the slim electronic devices are required. For example, an acoustic device for a slim digital TV may include a down-firing type front speaker and a back-firing type woofer. The down-firing type front speaker is installed at a lower part of the bezel of the digital TV to emit moderate/high-pitched sounds to a lower side of the digital TV. The back-firing type woofer is installed at a rear surface of the digital TV to emit low-pitched sounds to a rear side and transfer the low-pitched sounds to a front side through the diffraction of sound waves. However, as electronic devices become ultra-slim, the degradation of sound quality is increased.

SUMMARY

Exemplary embodiments provide an electronic device employing a sound plate switchable between a stand type and a hang type, which is suitable for an electronic device having a slim structure, such as an ultra-slim digital TV.

According to an aspect of an exemplary embodiment, there is provided an electronic device including: a main body that performs a preset function; a sound plate including at least one speaker unit which emits a sound according to an electric signal transmitted from the main body, and a flat plate which accommodates the at least one speaker unit; and a coupling unit which couples the main body and the sound plate, the main body and the sound plate being movable to one of a first arrangement and a second arrangement, wherein in the first arrangement the sound plate supports the main body from below the main body, and wherein in the second arrangement the sound plate is disposed at a rear of the main body, and wherein in the first arrangement the sound plate emits the sound through at least one slit provided on a side surface of the flat plate, and in the second arrangement the sound plate emits the sound through an opening provided on a front of the flat plate.

In the first arrangement, the at least one slit may be located in a lower portion of the side surface of the flat plate, and the sound is emitted through the at least one slit in the first arrangement in a forward direction without being reflected from a rear surface of the main body or a rear surface of the sound plate.

The at least one speaker unit may be disposed in such a way that an acoustic diaphragm faces the opening of the flat plate in the second arrangement.

The opened portion of the flat type plate may protrude below the main body, in the second arrangement.

The main body may include a display panel for displaying an image.

The electronic device may further include an equalizer which processes a sound according to a first equalizing mode corresponding to the first arrangement and a second equalizing mode corresponding to the second arrangement.

The equalizer may be a parametric equalizer.

The coupling unit may include: a first coupling unit which detachably couples the sound plate to a bottom of the main body in the first arrangement; and a second coupling unit which detachably couples the sound plate to a rear of the main body in the second arrangement.

The flat plate may include: a first plate; and a second flat having the opening to which an acoustic diaphragm of the at least one speaker unit faces, wherein the opening of the second plate may be covered by a slit cover in the first arrangement, and may be covered by a grill cover through which air is flowable in the second arrangement.

The first coupling unit may detachably couple the first plate of the flat plate to the bottom of the main body, and the second coupling unit may detachably couple the second plate of the flat plate to the rear of the main body.

The at least one speaker unit may include a woofer module and a tweeter module, which are arranged in parallel to one another in a space between the first plate and the second plate of the flat plate.

The woofer module may include a frame which seals the first plate and the second plate of the flat plate to enclose the woofer module within the first and second plates.

The woofer module and the tweeter module may be disposed in a pair at a left side and a right side of the speaker module.

The coupling unit may include a hinge that rotates the sound plate to a position below the main body in the first arrangement, and to a position at the rear of the main body in the second arrangement.

The at least one speaker unit may be detachably installed in the flat plate.

The sound plate may include first and second speaker modules that accommodate the at least one speaker unit, and wherein the first and second speaker modules are detachably installed respectively on the left and right sides of the flat plate, wherein the first and second speaker modules may be reversed up and down, and right and left relative to one another between the first arrangement and the second arrangement.

The at least one speaker unit may include a woofer and a tweeter installed in each of the first and second speaker modules.

An acoustic diaphragm of the at least one speaker unit may be exposed to an outside of the first and second speaker modules.

A portion of the first and second speaker modules which exposes the acoustic diagram of the at least one speaker unit is blocked by the flat plate in the first arrangement, and may align with the opening of the flat plate in the second arrangement. An electronic device includes a main body that generates an electric signal; a sound plate comprising a housing and at least one speaker unit disposed in the housing and which emits a sound according to the electric signal; wherein the main body and the sound plate are attachable to one another according to a first arrangement which supports the main body from above or below the main body and a second arrangement which supports the main body from a rear of the main body, wherein in the first arrangement the sound plate emits the sound through a first opening provided on a first surface of the housing, and wherein in the second arrangement the sound plate emits the sound through a second opening provided on a second surface of the housing perpendicular to the first surface of the housing.

The first opening may be a slit.

The slit may be disposed at a side of the first surface of the housing that is away from the main body in the first arrangement.

The housing of the sound plate may extend along a plane that is perpendicular to the main body in the first arrangement, and the housing of the sound plate may extend along a plane that is parallel to the main body in the second arrangement.

The equalizer may process the sound according to frequency bands.

BRIEF DESCRIPTION OF THE DRAWINGS

The above and other features and advantages of the exemplary embodiments will become more apparent with reference to the attached drawings in which.

DETAILED DESCRIPTION OF THE EXEMPLARY EMBODIMENTS

Figure 1:
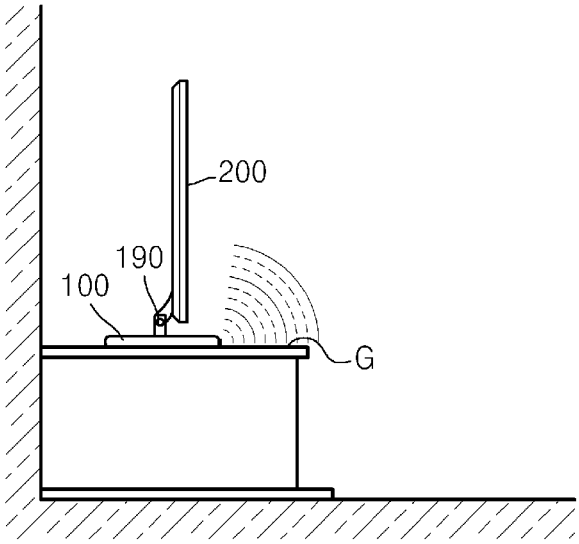
FIG. 1 is a side view of an electronic device arranged in a stand type, according an exemplary embodiment.

Hereinafter, the exemplary embodiments will be described more fully with reference to the accompanying drawings. The inventive concept may, however, be embodied in many different forms and should not be construed as being limited to the exemplary embodiments set forth herein; rather, these exemplary embodiments are provided so that this disclosure will be thorough and complete, and will fully convey the novel concept to those skilled in the art. In the drawings, like reference numerals denote like elements, and the sizes and thicknesses of layers and regions are exaggerated for clarity.

FIGS. 1 through 4 are views of an electronic device according to an exemplary embodiment.

Figure 2:
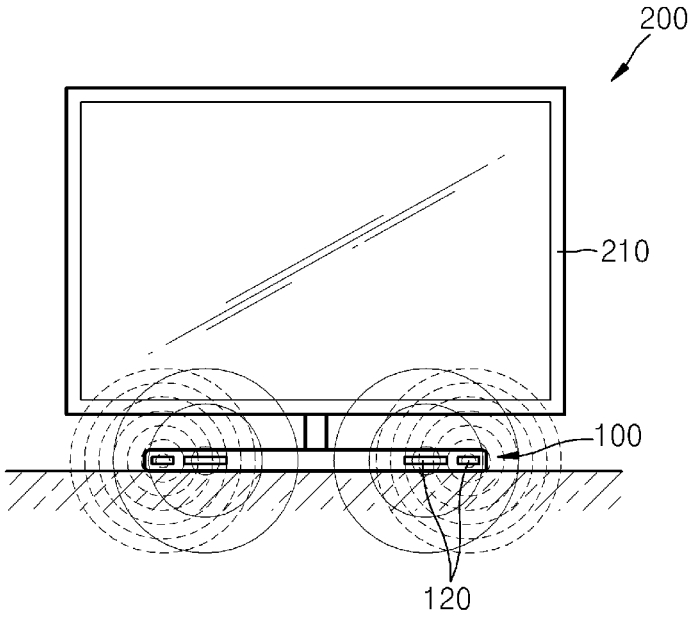
FIG. 2 is a front view of the electronic device of FIG. 1 arranged in the stand type.
Figure 3:
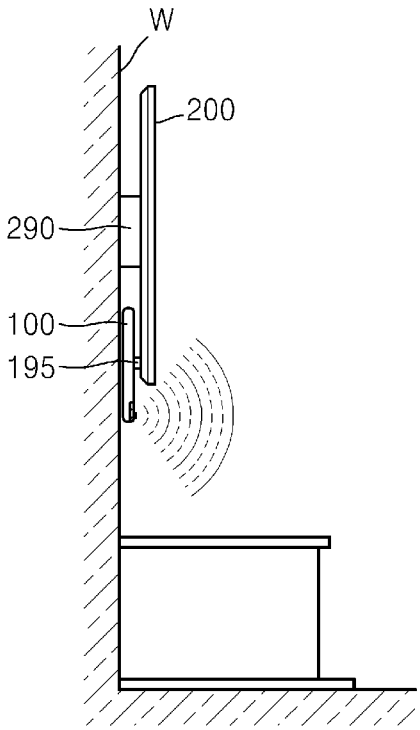
FIG. 3 is a side view of the electronic device of FIG. 1 arranged in a hang type.
Figure 4:
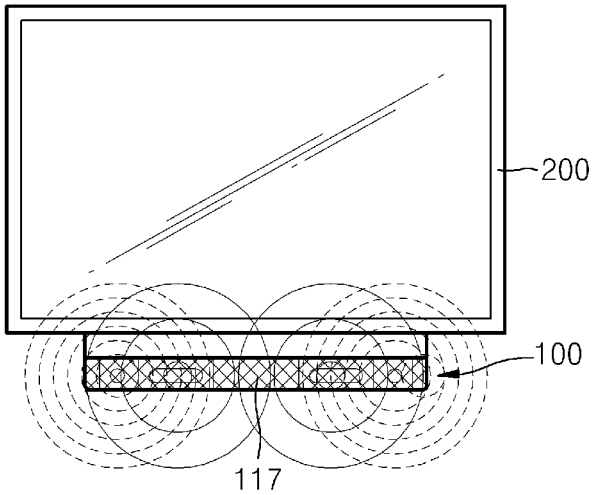
FIG. 4 is a front view of the electronic device of FIG. 1 arranged in the hang type.

FIGS. 1 and 2 are views of the electronic device arranged in a stand type, and FIGS. 3 and 4 are views of the electronic device arranged in a hang type.

Referring to FIGS. 1 through 4, the electronic device according to the exemplary embodiment includes a sound plate 100, a main body 200, and a first coupling unit 190.

The electronic device may be audio/video equipment such as a digital television (DTV). To perform preset functions, the main body 200 may include a display panel 210 displaying an image, and other signal processors (not shown).

In the electronic device, the sound plate 100 is separated from the main body 200. The electronic device may be arranged in the stand type as shown, for example, in FIGS. 1 and 2 or in the hang type as shown, for example, in FIGS. 3 and 4, according to the position of the sound plate 100. The stand type arrangement and the hang type arrangement may be mutually switched. An exemplary method of mutually switching the stand type and the hang type will be described later.

When the electronic device is arranged in the stand type as shown in FIGS. 1 and 2, the sound plate 100 is coupled with the main body 200 by the first coupling unit 190, and is arranged in a first arrangement, or state, to perform functions of a stand for supporting the main body 200. In the first arrangement, the sound plate 100 is a slit-firing speaker system that emits sounds through a plurality of slits 120 defined in a side surface thereof, as will be described later. Further, in the first arrangement, the sound plate 100 is to be placed on a bottom support surface G, and the sound plate 100 may satisfy a ground plane radiation condition.

When the electronic device is arranged in the hang type as shown in FIGS. 3 and 4, the sound plate 100 is arranged in a second arrangement, wherein the sound plate 100 is coupled to the rear of the main body 200 by a second coupling unit 195. In the second arrangement, the main body 200 may be adhered to a wall W by using a separate coupling unit 290. Alternatively, the sound plate 100 may be directly adhered to the wall W. In the second arrangement, the sound plate 100 is a front firing speaker system which directly emits sounds frontward. A portion of the sound plate 100 through which the sounds are emitted may be covered by a grill cover 117. The grill cover 117 has a net structure through which air freely flows.

The first and second coupling units 190 and 195 detachably couple the sound plate 100 to the main body 200. The present exemplary embodiment is not limited to the specific structure or configuration of the first and second coupling units 190 and 195, and thus, the first and second coupling units 190 and 195 may be realized through various forms known in the corresponding technical field. An audio signal outputted from the main body 200 may be transmitted to a speaker module 130 of FIG. 6 within the sound plate 100 through a cable (not shown) passing through the first or second coupling unit 190 or 195.

In general, a speaker system occupies a predetermined volume due to its mechanical structure which thereby restricts the ability to decrease the thickness of the main body 200. However, in the electronic device according to the exemplary embodiment, since the sound plate 100, that is, the speaker system, is separated from the main body 200, the thickness of the main body 200 is not limited to the size and shape of the speaker system. The display panel 210 may be an ultra-slim flat panel such as a liquid crystal panel, an organic light emitting panel, and a plasma display panel so that the main body 200 may be slim. Furthermore, since the sound plate 100, which is a vibration source, is separated from the main body 200, vibration limitations of the main body 200 may be solved. Thus, a mechanical design of the main body 200 may instead focus on overcoming thermal emission limitations.

Figure 5:
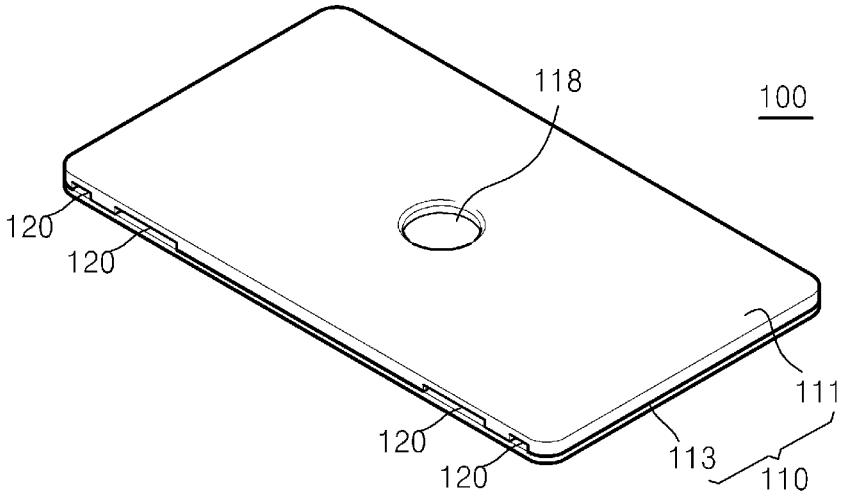
FIG. 5 is a perspective view illustrating only a sound plate of the electronic device of FIG. 1, according to an exemplary embodiment.
Figure 6:
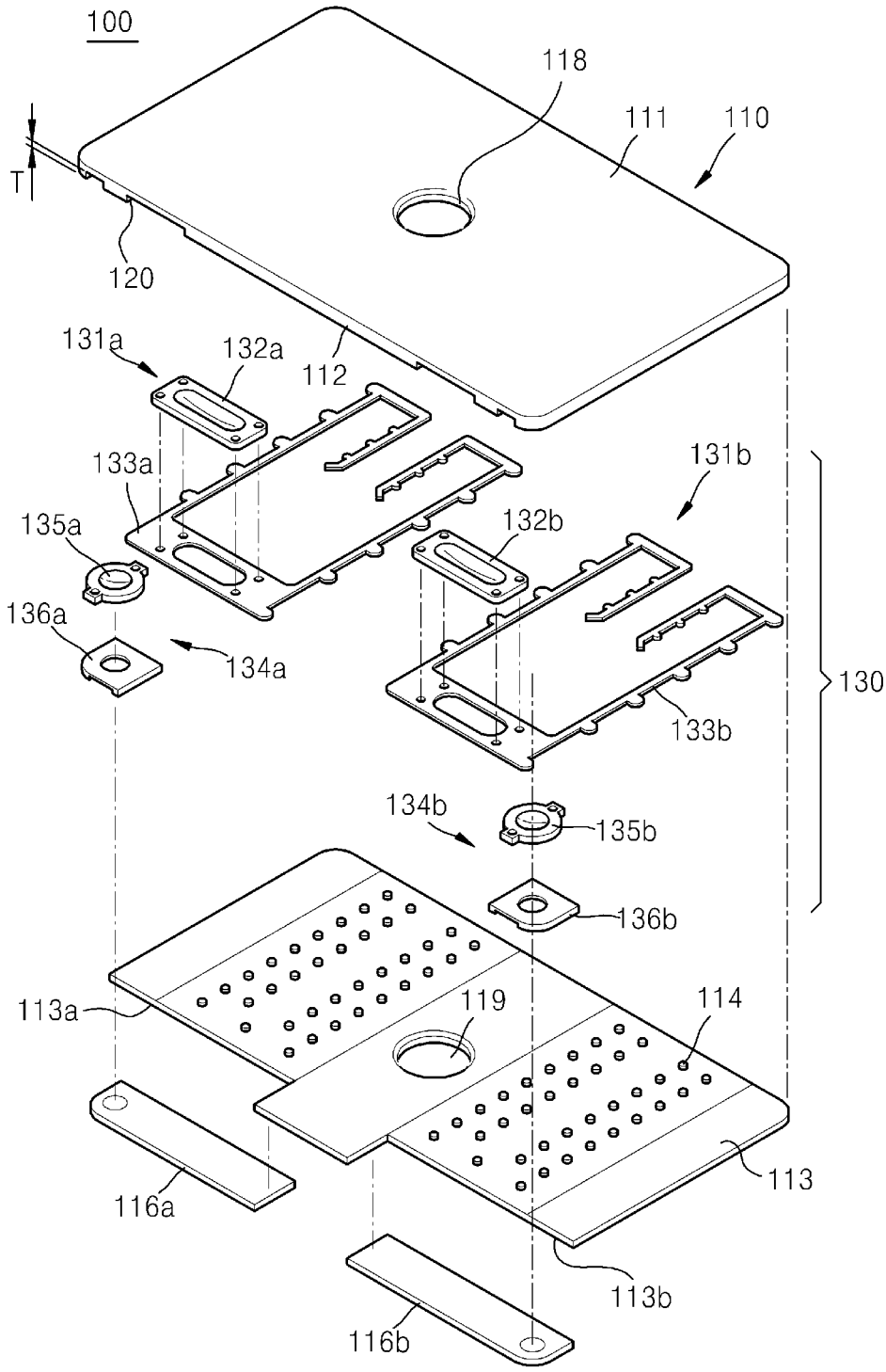
FIG. 6 is an exploded perspective view of the sound plate of FIG. 5.

FIG. 5 is a perspective view illustrating only the sound plate 100 of the electronic device of FIG. 1, according to an exemplary embodiment, and FIG. 6 is an exploded perspective view of the sound plate 100 of FIG. 5.

Referring to FIGS. 5 and 6, the sound plate 100 includes a support plate 110 and the speaker module 130 disposed within the support plate 110. The support plate 110 may have a thin flat plate shape in which an upper plate 111 and a lower plate 113 are coupled to one another.

A predetermined space is defined between the upper plate 111 and the lower plate 113 to dispose the speaker module 130 therein. A first coupling part 118 for coupling the upper plate 111 to the first coupling unit 190 of FIG. 1 is defined in the upper plate 111, and a second coupling part 119 for coupling the lower plate 113 to the second coupling unit 195 of FIG. 3 is defined in the lower plate 113. The first and second coupling parts 118 and 119 may have a simple groove or a groove with a female screw structure. The shape of the first and second coupling parts 118 and 119 may vary according to a coupling method of the first and second coupling units 190 and 195.

The plurality of slits 120 are defined in a side surface 112 of the support plate 110 to emit sounds outputted from the speaker module 130. The plurality of slits 120 may be in the same number as that of speaker units included in the speaker module 130. For example, as described below, when the speaker module 130 includes a pair of woofer modules 131*a* and 131*b* and a pair of tweeter modules 134*a* and 134*b*, four slits 120 may be provided to independently emit sounds outputted from the pair of woofer modules 131*a* and 131*b* and the pair of tweeter modules 134*a* and 134*b*.

Figure 9:
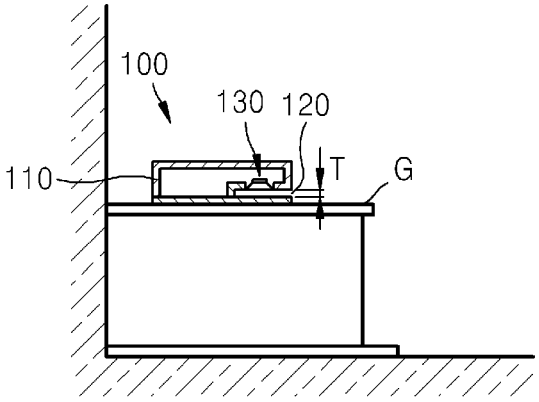
FIG. 9 is a schematic side cross-sectional view of a sound plate for describing a ground plane radiation when the electronic device of FIG. 1 is arranged in the stand type.

Each of the plurality of slits 120 is designed to have a thickness T, as shown in FIGS. 6 and 9, less than a wavelength of each of the sounds emitted through the plurality of slits 120 to serve as an acoustic center of the sound emission of the plurality of slits 120. For example, each of the plurality of slits 120 may be designed to have the thickness T less than one quarter of about 17 mm, which is a wavelength of an audible limit frequency. The support plate 110 may be designed with sufficiently thin thickness so that the emitted sounds are negligibly reflected from the side surface 112 of the support plate 110. For example, the support plate 110 may be designed with a thickness of less than about 20 mm. Also, the plurality of slits 120 may be disposed at a lower portion of the side surface 112 of the support plate 110. The plurality of slits 120 may satisfy a ground plane radiation condition when the sound plate 100 is arranged in the first arrangement, i.e., when the electronic device is arranged in the stand type. The ground plane radiation will be described later.

Parts of the lower plate 113 of the support plate 110 may be removed to form opened portions 113*a* and 113*b*. The opened portions 113*a* and 113*b* expose acoustic diaphragms 139 (shown in FIG. 8C) of woofers 132*a* and 132*b* and tweeters 135*a* and 135*b*, which will be described later, to an outside of the support plate 110. When the sound plate 100 is in the first arrangement, the opened portions 113*a* and 113*b* are respectively covered by slit covers 116*a* and 116*b*. When the sound plate 100 is in the second arrangement, i.e., when the electronic device is arranged in the hang type, the slit covers 116*a* and 116*b* are removed and sounds outputted from the woofers 132*a* and 132*b* and tweeters 135*a* and 135*b* are directly emitted through the opened portions 113*a* and 113*b*. The opened portions 113*a* and 113*b* may be covered by a grill cover 117 of FIG. 4.

As shown in FIG. 6, the speaker module 130 may include the pair of woofer modules 131*a* and 131*b* and the pair of tweeter modules 134*a* and 134*b*. The woofer modules 131*a* and 131*b* and the tweeter modules 134*a* and 134*b* may be horizontally arranged in bilateral symmetry with respect to the support plate 110. For example, as shown in FIGS. 4 and 6, the pair of woofer modules 131*a* and 131*b* may be symmetrically arranged on both left and right sides of a central portion of the support plate 110, and the pair of tweeter modules 134*a* and 134*b* may be symmetrically arranged on both left and right sides of the outside of the central portion of the support plate 110. Also, the woofer modules 131*a* and 131*b* and the tweeter modules 134*a* and 134*b* may be disposed adjacent to the plurality of slits 120.

Figure 7:
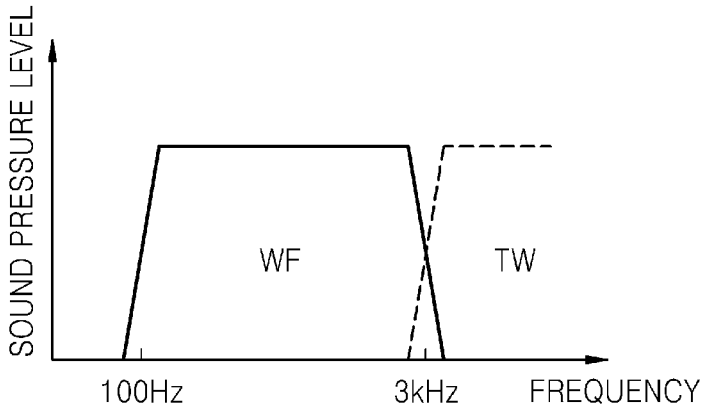
FIG. 7 is a view illustrating an example of a frequency band of a woofer and a tweeter of the sound plate of FIG. 5.

Each of the pair of woofer modules 131*a* and 131*b* may include woofers 132*a* and 132*b* and frames 133*a* and 133*b*, respectively. The woofers 132*a* and 132*b* may be used as a speaker for a low frequency range. For example, as shown in FIG. 7, the woofers 132*a* and 132*b* may be designed to output a moderate/low-pitched sound WF having a frequency band of about 100 Hz to about 3 kHz. The woofers 132*a* and 132*b* are disposed in such a way that acoustic diaphragms 139 are placed on the opened portions 113*a* and 113*b* of the lower plate 113. Each of the frames 133*a* and 133*b* has a holder structure for respectively holding the woofers 132*a* and 132*b* at one side thereof. Also, each of the frames 133*a* and 133*b* has a wall structure for sealing the upper plate 111 and the lower plate 113 at the other side thereof. A space sealed by each of the frames 133*a* and 133*b* between the upper plate 111 and the lower plate 113 serves as an enclosure for amplifying the low-pitched sound outputted from the woofers 132*a* and 132*b*. As the upper plate 111 and the lower plate 113 of the support plate 110 are used as the enclosure, the ultra-slim sound plate 100 may be realized. Furthermore, the upper plate 111 and the lower plate 113 of the support plate 110 may easily prevent the sound plate 100 from self-vibrating by the low-pitched sound. Also, the frames 133*a* and 133*b* serve as a support to maintain a state in which the upper plate 111 and the lower plate 113 of the support plate 110 are spaced from each other.

A plurality of screw holes 114 for screw coupling or ribs (not shown) may be disposed in/on the upper plate 111 and/or the lower plate 113 of the support plate 110. The screw holes 114 or ribs may be disposed at points at which the self-vibration strongly occurs by the low-pitched sound outputted from the woofers 132*a* and 132*b*. In addition, the screw holes 114 or ribs may reinforce the rigidity of the support plate 110.

Each of the tweeter modules 134*a* and 134*b* may include tweeters 135*a* and 135*b* and tweeter holders 136*a* and 136*b*, respectively. The tweeters 135*a* and 135*b* may be used as a speaker for a high frequency range. For example, as shown in FIG. 7, the tweeters 135*a* and 135*b* may be designed to output a high-pitched sound TW having a frequency band equal to or above about 3 kHz. Although a frequency band in which frequency bands of the woofer modules 131*a* and 131*b* overlap with those of tweeter modules 134*a* and 134*b* is about 3 kHz in FIG. 7, the exemplary embodiment is not limited thereto. For example, the overlapping frequency band may vary according to design. The tweeters 135*a* and 135*b* are disposed to allow the acoustic diaphragms to be disposed respectively on the opened portions 113*a* and 113*b* of the lower plate 113. Furthermore, the acoustic diaphragms of the tweeters 135*a* and 135*b* may be inclined toward an adjacent slit 120. Thus, radiation directions of the sounds may be inclined toward the slits 120.

FIGS. 8A through 8F are figures for illustrating an exemplary method of switching the electronic device of FIG. 1 from being arranged in the stand type to the hang type.

Figure 8A:
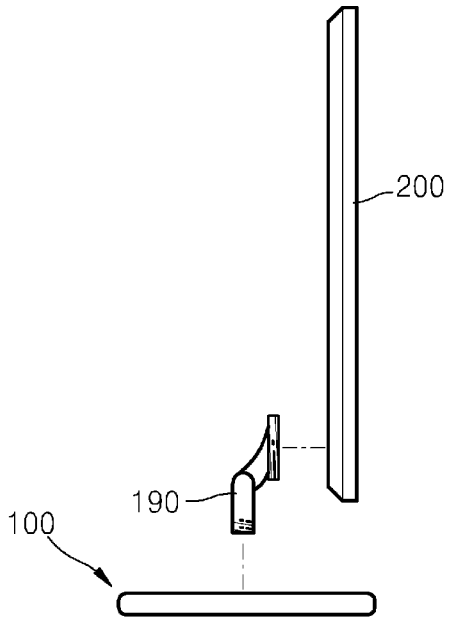
FIGS. 8A through 8F are diagrams for describing a method of switching the electronic device of FIG. 1 from being arranged in the stand type to the hang type.
Figure 8B:
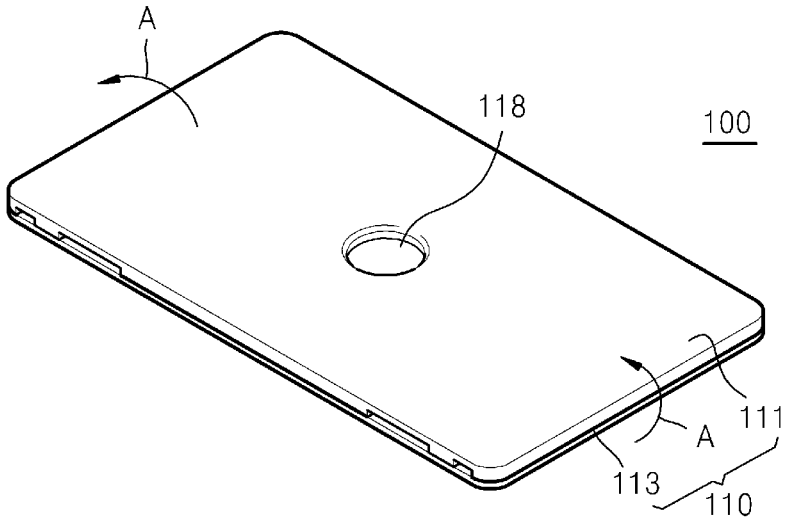
Figure 8C:
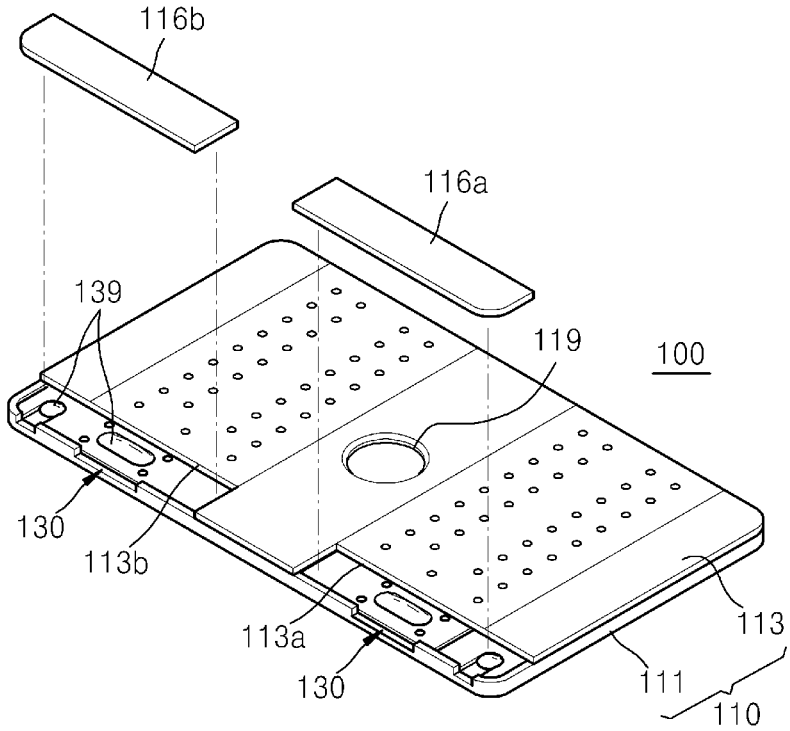
Figure 8D:
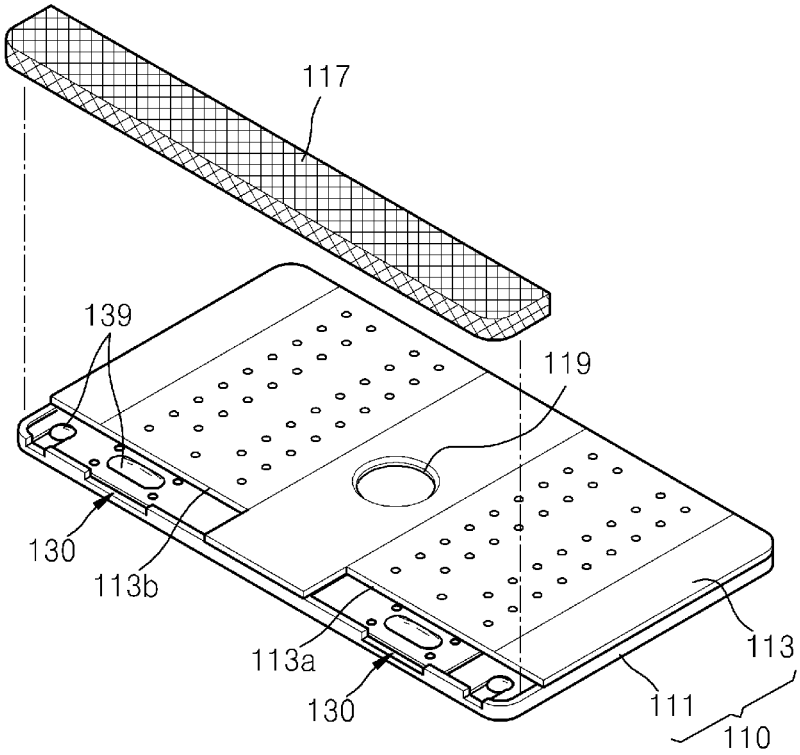
Figure 8E:
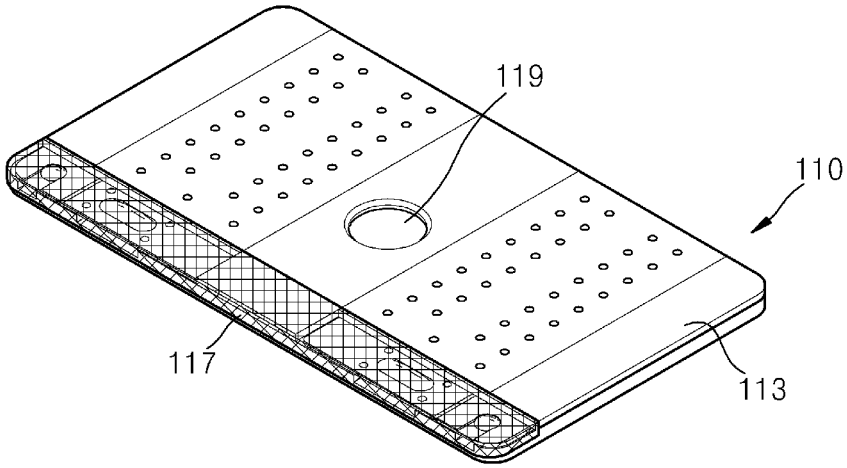
Figure 8F:
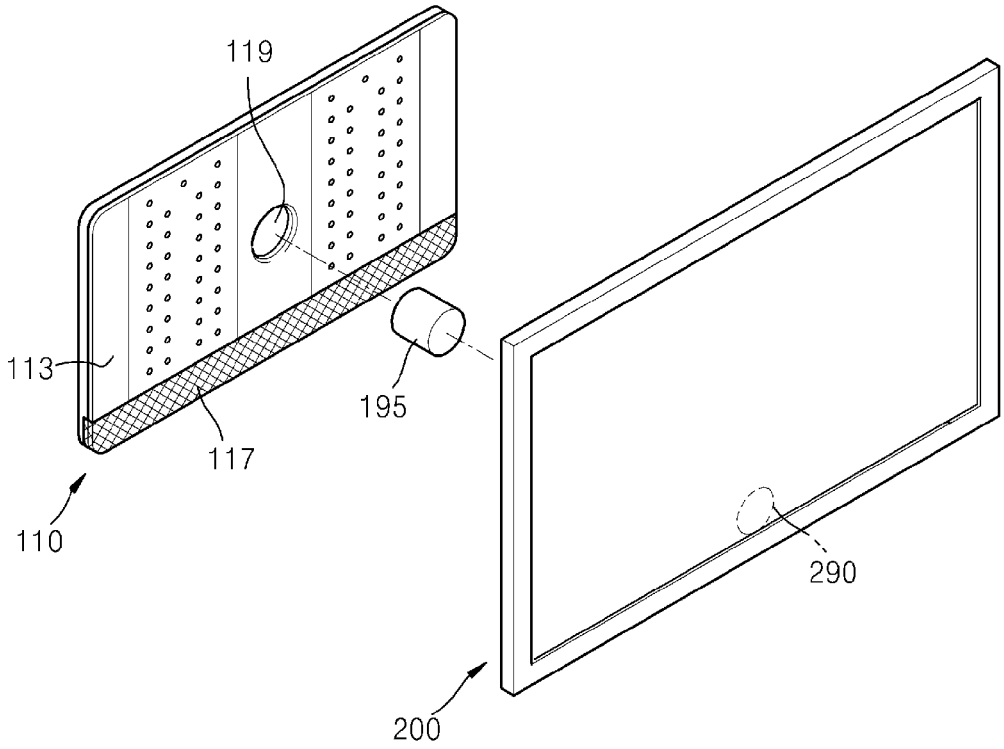

First, as shown in FIG. 8A, the sound plate 100 is separated from the main body 200 when the electronic device is in the stand type. Then, as shown in FIG. 8B, the sound plate 100 is turned over in the direction shown by the arrows A, so that the upper plate 111 of the support plate 110 faces downward and the lower plate 113 of the support plate 110 faces upward. Then, as shown in FIG. 8C, the slit covers 116*a* and 116*b* are separated from the turned over support plate 110. Accordingly, acoustic diaphragms 139 of the speaker module 130 are exposed to outside the support plate 110 through the opened portions 113*a* and 113*b* of the support plate 110. Then, as shown in FIGS. 8D and 8E, the opened portions 113*a* and 113*b* of the support plate 110 are covered by the grill cover 117. Then, as shown in FIG. 8F, the second coupling part 119 of the lower plate 113 of the support plate 110 is coupled with the separate coupling unit 290 of the main body 200 by using the second coupling unit 195, thereby switching the electronic device to the hang type. Moreover, as will be described later, an adjustment value of an equalizer optimized to the sound plate 100 when the electronic device is in the stand type is changed to an adjustment value optimized when the electronic device is in the hang type. Such switching of equalization will be described later.

In the electronic device according to the exemplary embodiment, the electronic device may be switched from the hang type to the stand type in reverse order of the method of FIGS. 8A through 8F.

FIG. 9 is a schematic side cross-sectional view of the sound plate 100 for describing a ground plane radiation when the electronic device of FIG. 1 is arranged in the stand type. Referring to FIG. 9, the sound plate 100 may be placed on the bottom support surface G, i.e., on a ground. Since the plurality of slits 120 are defined at the lower portion of the side surface 112 of the support plate 110, the plurality of slits 120 are disposed adjacent to the bottom support surface G. Also, since each of the plurality of slits 120 is designed to have a thickness T less than a wavelength of the sound emitted from the speaker module 130, the plurality of slits 120 correspond to an acoustic center of the sound emission. Thus, the sound plate 100 of the exemplary embodiment may satisfy the ground plane radiation condition in which the sound is emitted upwardly from the bottom surface at a solid angle of about $2\pi$.

Because the sound plate 100 realizes the ground plane radiation, the outputted sound may be emitted forward without being reflected at a rear side to secure sound quality similar to that of a front-firing type speaker. For example, the sound plate 100 of the exemplary embodiments may achieve very clear impulse response characteristics and remarkable and a quick decrease of distortion caused by a reflected sound. Also, since the ground plane radiation condition is satisfied, an acoustic axis is disposed in an upward position, and the electronic device may have optimum "sweet spots," i.e., a focal point between the speaker units where the sounds emitted from the speaker units mix in the intended manner, located at the center and the front surface thereof. Moreover, since the self vibration of the sound plate 411 may be restrained by a weight of the main body 200, the electronic device is strong against vibration.

Figure 10:
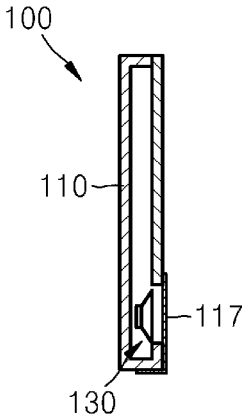
FIG. 10 is a schematic side cross-sectional view of a sound plate for describing a front-firing when the electronic device of FIG. 1 is arranged in the hang type.

FIG. 10 is a schematic side cross-sectional view of the sound plate 100 for describing a front-firing when the electronic device of FIG. 1 is arranged in the hang type.

Referring to FIG. 10, the sound plate 100 is vertically erected, and the acoustic diaphragm of the speaker module 130 is faced forward. Accordingly, sounds are directly emitted forward through the grill cover 117. As such, since the sound plate 100 front-fires, high sound quality may be secured.

In case of a slim digital TV employing a back-firing type woofer of the related art, a low-pitched sound is emitted to a backside to diffract the low-pitched sound, thereby transferring the low-pitched sound to a front side. However, since the back-firing type woofer excites a back cover of the digital TV to generate unnecessary vibration and an acoustic mode, sound playback and articulation with respect to the low-pitched sound are deteriorated. Also, a sound pressure dip due to a path difference of the rear-side sound occurs based on a listening position. On the other hand, according to the electronic device of the exemplary embodiment, since the sound plate 100 is a speaker system that is separated from the main body 200, vibration is not generated at the main body 200 of the electronic device as a result of the sound plate which improves the sound playback and articulation with respect to the low-pitched sound. Also, the sound pressure dip due to the path difference of the rear-side sound does not occur.

Also, in the electronic device of the exemplary embodiment, since the woofer and the tweeter are disposed adjacent to each other, the sound pressure dip based on the listening position is not generated nearly to the extent as that of the related art when a high order filter is used as the PEQ.

Equalization of the electronic device according to the exemplary embodiment will be described below with reference to FIGS. 11 to 17.

Figure 11:
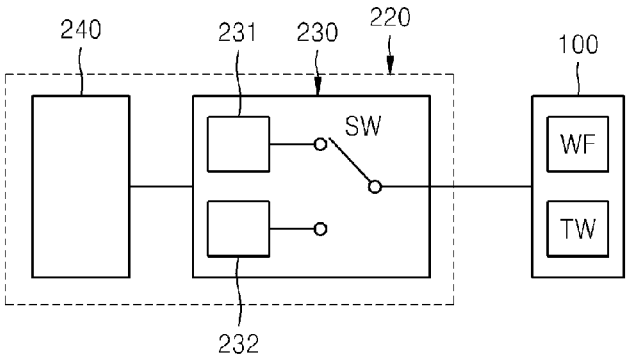
FIG. 11 is a diagram of an equalizer of the electronic device of FIG. 1, according to an exemplary embodiment.

Referring to FIG. 11, a signal processor 220 of the electronic device according to the exemplary embodiment includes an equalizer 230 and a memory 240. The equalizer 230 performs a signal process of adjusting a frequency response of an audio signal demodulated in the main body 200 of the electronic device, and thus is used to correct characteristics of the sound plate 100. The equalizer 230 may be, for example, a parametric equalizer (PEQ). The memory 240 stores a PEQ value corresponding to the stand type and a PEQ value corresponding to the hang type.

The equalizer 230 includes first and second equalizing modes 231 and 232. In the first equalizing mode 231, the electronic device is arranged in the stand type, and thus the equalizer 230 reads the PEQ value corresponding to the stand type from the memory 240 and adjusts a frequency response. In the second equalizing mode 232, the electronic device is arranged in the hang type, and thus the equalizer 230 reads the PEQ value corresponding to the hang type from the memory 240 and adjusts a frequency response. The first and second equalizing modes 231 and 232 are switched according to the arrangement of the electronic device, and may be switched automatically or manually. For example when the sound plate 100 is mutually switched between the first and second arrangements, the first and second equalizing modes 231 and 232 may be mutually switched using a mechanical method, such as by changing an electric wire. Alternatively, the first and second equalizing modes 231 and 232 may be mutually switched using an electric method, such as by detecting the arrangement of the sound plate 100 by using a separate sensor. Alternatively, the first and second equalizing modes 231 and 232 may be manually switched by a user using a separately-prepared physical switch or a software switch like a program menu.

Figure 12:
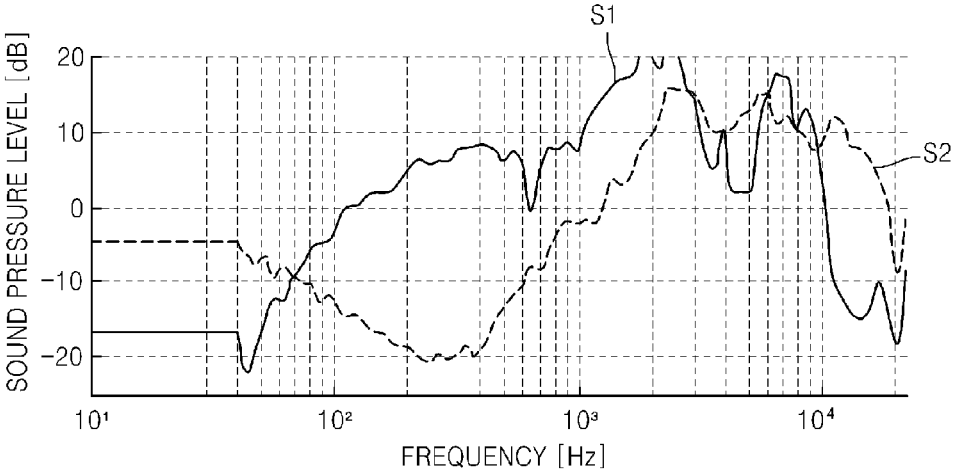
FIG. 12 is a view illustrating a sound pressure level before equalization in the electronic device of FIG. 1 arranged in the stand type.
Figure 13:
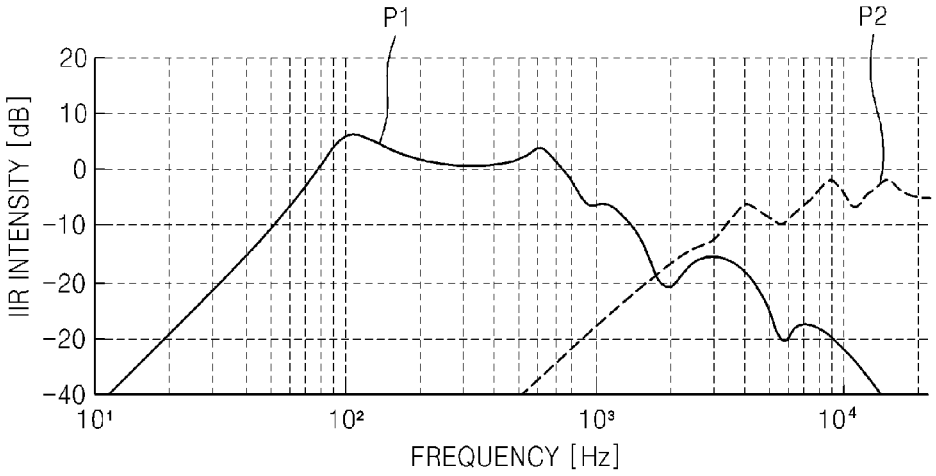
FIG. 13 is a view illustrating an example of a parametric equalizer (PEQ) set-up in the electronic device of FIG. 1 arranged in the stand type.
Figure 14:
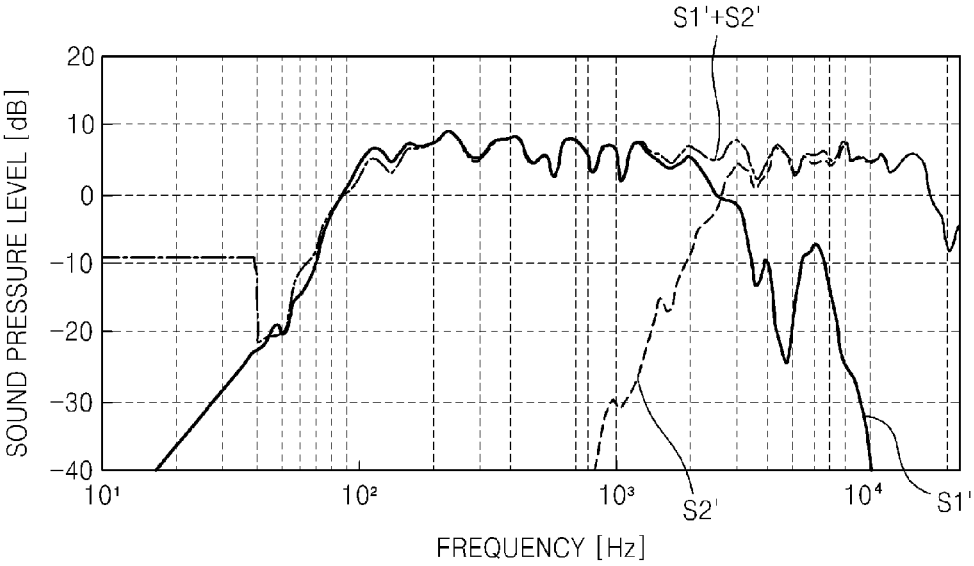
FIG. 14 is a view illustrating a sound pressure level after equalization in the electronic device of FIG. 1 arranged in the stand type.

FIGS. 12 through 14 are views illustrating an example of equalization when the electronic device of FIG. 1 is arranged in the stand type. For equalization, the sound plate 100 is disposed below the main body 200 on the bottom support surface G of FIG. 1 in the stand type, and a sound pressure level is measured at a front side. FIG. 12 illustrates an example of a frequency response before the equalization. In FIG. 12, a solid line 51 represents a sound pressure waveform of the woofers 131*a* and 131*b* of FIG. 4, and a dashed line S2 represents a sound pressure waveform of the tweeters 135*a* and 135*b* of FIG. 4. After the sound pressure level is measured before the equalization, a crossover frequency is set based on the measured result. FIG. 13 illustrates an example of a PEQ value in the first equalizing mode 231. That is, equalizer filter coefficients are illustrated as a waveform of an infinite impulse response (IIR) with respect to a frequency axis. A solid line P1 represents a PEQ value with respect to the woofers 131*a* and 131*b*, and a dashed line P2 represents a PEQ value with respect to the tweeters 135*a* and 135*b*. FIG. 14 illustrates simulation results equalized by processing the audio signal to emphasize or de-emphasize the audio signal, which is demodulated by setting the PEQ value as shown in FIG. 13, according to frequency bands. In FIG. 14, a solid line S1' represents an equalized sound pressure waveform of the woofers 131*a* and 131*b*, and a dashed line S2' represents an equalized sound pressure waveform of the tweeters 135*a* and 135*b*. Referring to FIG. 14, when the electronic device is arranged in the stand type, it is seen that a sound pressure waveform S1'+S2' of the sum of the sound pressure waveforms of the woofers 131*a* and 131*b* and the tweeters 135*a* and 135*b* is relatively flat over the whole frequency band.

Figure 15:
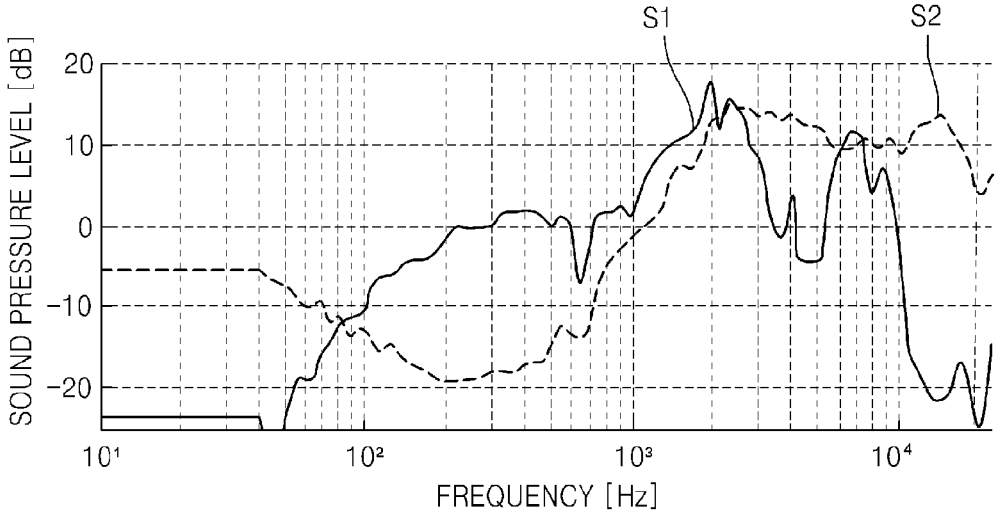
FIG. 15 is a view illustrating a sound pressure level before equalization in the electronic device of FIG. 1 arranged in the hang type.
Figure 16:
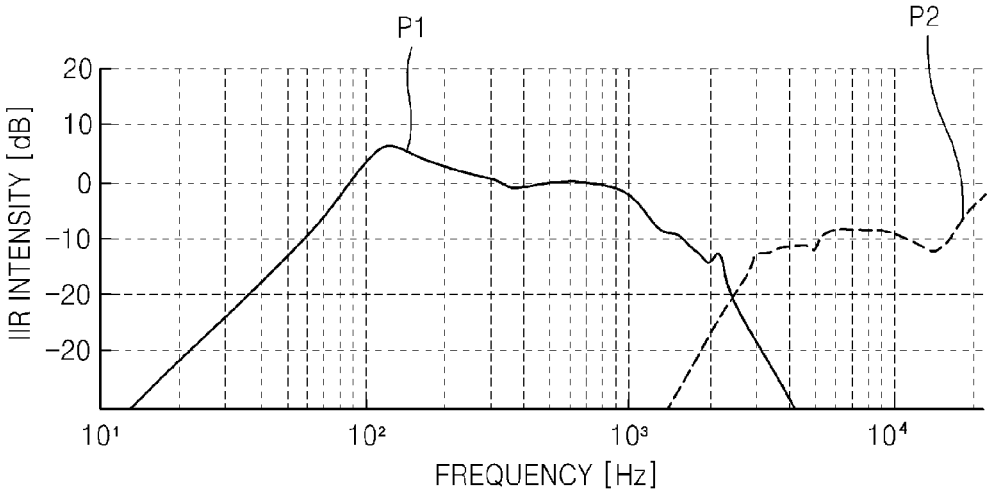
FIG. 16 is a view illustrating an example of a PEQ set-up in the electronic device of FIG. 1 arranged in the hang type.
Figure 17:
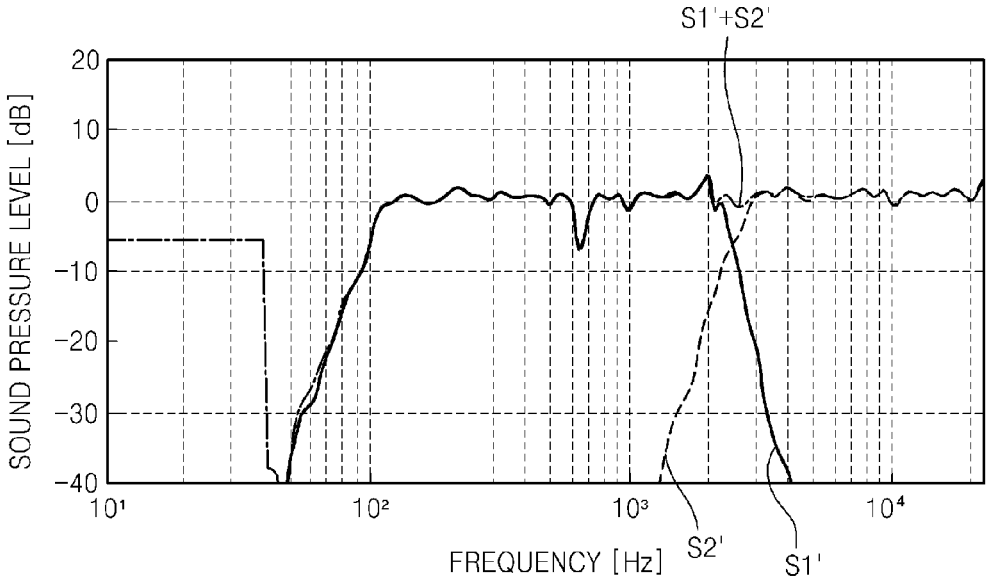
FIG. 17 is a view illustrating a sound pressure level after equalization in the electronic device of FIG. 1 arranged in the hang type.

Similarly, FIGS. 15 through 17 are views illustrating an example of equalization when the electronic device of FIG. 1 is arranged in the hang type. For equalization, the sound plate 100 is disposed at the rear of the main body 200 so that the main body 200 is hung on the wall W of FIG. 3 as the hang type, and a sound pressure level is measured at a front side. FIG. 15 illustrates an example of a frequency response before the equalizing the demodulated audio signal. In FIG. 15, a solid line S1 represents a sound pressure waveform of the woofers 131*a* and 131*b*, and a dashed line S2 represents a sound pressure waveform of the tweeters 135*a* and 135*b* of FIG. 4. FIG. 16 illustrates an example of a PEQ value in the second equalizing mode 232. A solid line P1 represents a PEQ value with respect to the woofers 131*a* and 131*b*, and a dashed line P2 represents a PEQ value with respect to the tweeters 135*a* and 135*b*. FIG. 17 illustrates simulation results equalized by processing the audio signal to emphasize or de-emphasize the audio signal, which is demodulated by setting the PEQ value as shown in FIG. 16, according to frequency bands. In FIG. 17, a solid line S1' represents an equalized sound pressure waveform of the woofers 131*a* and 131*b*, and a dashed line S2' represents an equalized sound pressure waveform of the tweeters 135*a* and 135*b*. Referring to FIG. 17, when the electronic device is arranged in the hang type, it is seen that a sound pressure waveform S1'+S2' of the sum of the sound pressure waveforms of the woofers 131*a* and 131*b* and the tweeters 135*a* and 135*b* is relatively flat over the whole frequency band.

In a down-firing type front speaker of the related art, a sound is outputted downward. Thus, when a high frequency sound is amplified by a PEQ, the non-linear distortion increases and amplifier saturation occurs before the high frequency sound reaches a maximum volume. That is, there is a limitation on an effect of PEQ amplification of a high frequency sound in the related art. On the other hand, as shown in FIGS. 12 to 17, the sound plate 100 of according to the exemplary embodiment may have superior low frequency extension and a high frequency range recording having high articulation through adapted equalization by switching the equalizing modes according to whether the electronic device is arranged in the stand type or in the hang type.

Figure 18:
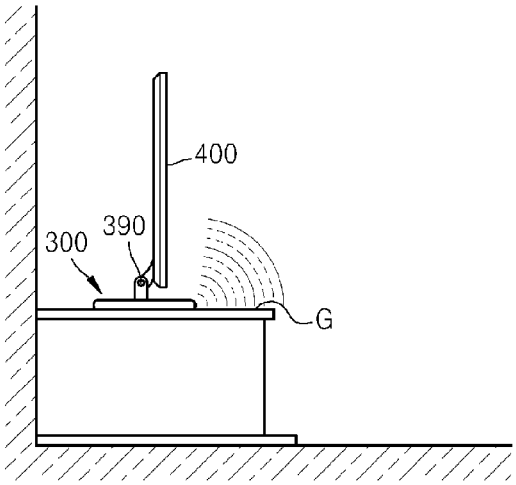
FIG. 18 is a side view of an electronic device arranged in a stand type, according to another exemplary embodiment.
Figure 19:
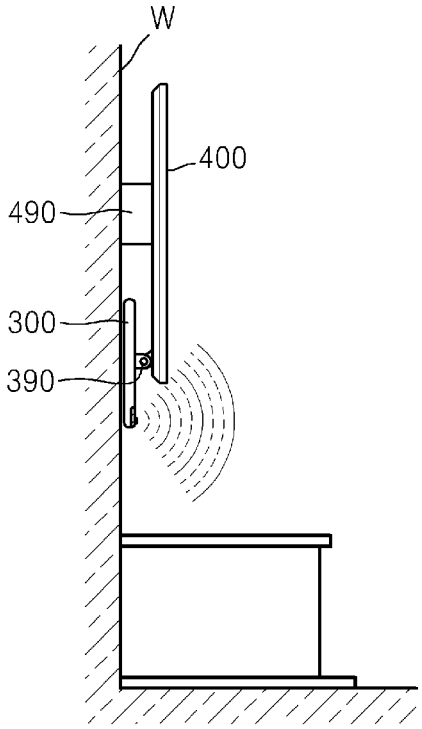
FIG. 19 is a side view of the electronic device of FIG. 18 arranged in a hang type.

FIGS. 18 and 19 illustrate an electronic device according to another exemplary embodiment. FIG. 18 is a side view of the electronic device arranged in a stand type, and FIG. 19 is a side view of the electronic device arranged in a hang type.

Referring to FIGS. 18 and 19, the electronic device according to the exemplary embodiment includes a sound plate 300, a main body 400, and a coupling unit 390. The electronic device according to the current exemplary embodiment is substantially identical to the electronic device according to the previous exemplary embodiment, except that the coupling unit 390 includes a hinge that is foldable.

The coupling unit 390 including the hinge rotatably couples the sound plate 300 with the main body 400. The first arrangement of the sound plate 300, wherein the electronic device is arranged in the stand type, and the second arrangement of the sound plate 300, wherein the electronic device is arranged in the hang type, are determined according to a rotation angle of the coupling unit 390. The structure and shape of the hinge of the coupling unit 390 is not limited to the current exemplary embodiment and may vary. In the second arrangement, the main body 400 may be adhered to the wall W by using a separate coupling unit 490. Alternatively, the sound plate 300 may be adhered to the wall W.

The electronic device of the current exemplary embodiment is similar to the electronic device of the previous exemplary embodiment, since in both electronic devices, the sound plate 300 is separated from the main body 400 and the sound plate 300 is switchable between the stand type and the hang type. Also, the electronic devices of the exemplary embodiments are similar since the sound plate 300 is a slit-firing speaker system that satisfies the ground plane radiation condition when arranged in the stand type, and is a front-firing speaker system when arranged in the hang type.

Figure 20:
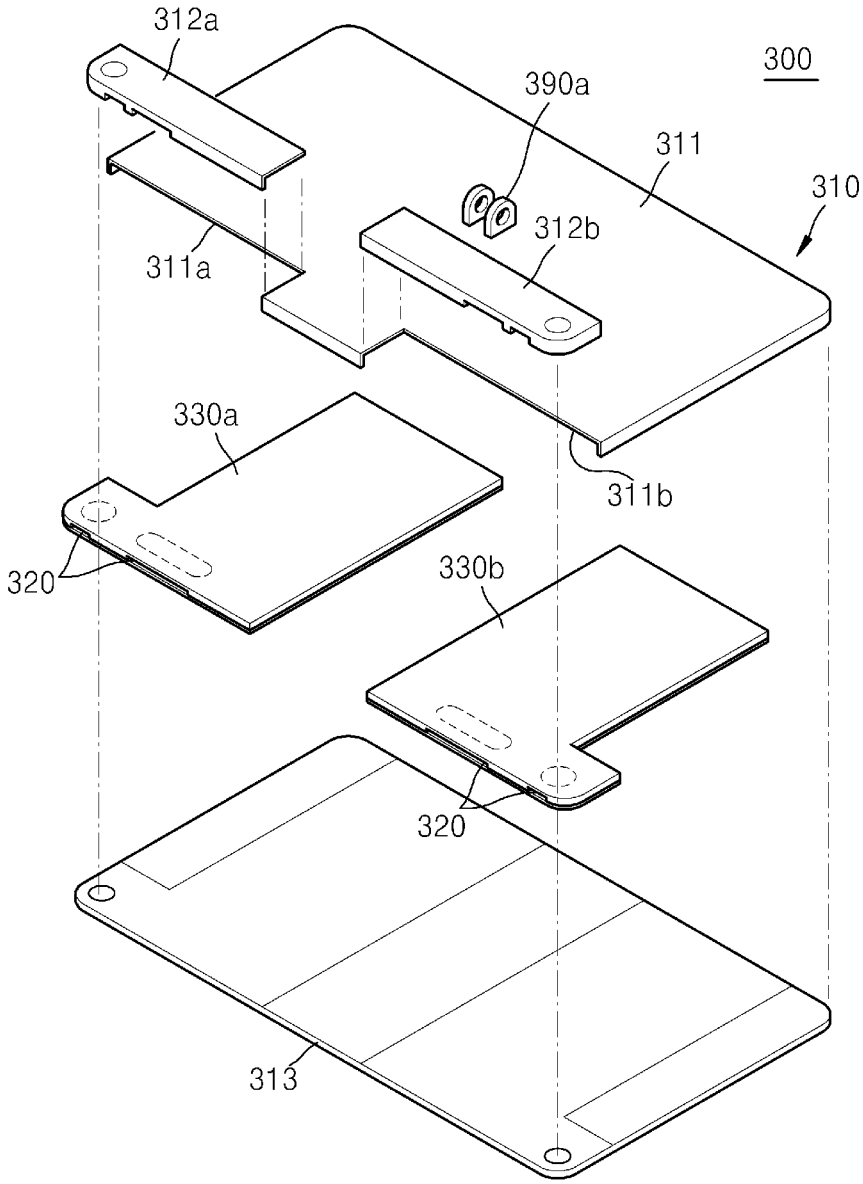
FIG. 20 is an exploded perspective view of a sound plate illustrated in FIG. 18.

FIG. 20 is an exploded perspective view of the sound plate 300 illustrated in FIG. 18. Referring to FIG. 20, the sound plate 300 includes a support plate 310, and first and second speaker modules 330*a* and 330*b* installed inside the support plate 310. The support plate 310 may have a thin flat plate shape in which an upper plate 311 and a lower plate 313 are coupled.

A coupling part 390*a*, which is a part of the coupling unit 390 of FIG. 18, is disposed on the upper plate 311. A structure of the coupling part 390*a* may differ according to the structure of the hinge of the coupling unit 390.

Parts of the upper plate 311 of the support plate 310 are removed to form opened portions 311*a* and 311*b*. The opened portions 311*a* and 311*b* expose acoustic diaphragms of woofers 333*a* and 333*b* of FIG. 22C and tweeters 336*a* and 336*b* of FIG. 22C to the outside of the support plate 310. When the sound plate 300 is in the first arrangement, the opened portions 311*a* and 311*b* are respectively covered by slit covers 312*a* and 312*b*. When the sound plate 300 is in the second arrangement, i.e., when the electronic device is arranged in the hang type, the slit covers 312*a* and 312*b* are removed, and sounds outputted from the woofers 333*a* and 333*b* and tweeters 336*a* and 336*b* are emitted through the opened portions 311*a* and 311*b*. The opened portions 311*a* and 311*b* may be covered by a grill cover 317 as shown in FIG. 22C.

A predetermined space is defined between the upper plate 311 and the lower plate 313 to dispose the first and second speaker modules 330*a* and 330*b* therein. The first and second speaker modules 330*a* and 330*b* are disposed side by side. The first and second speaker modules 330*a* and 330*b* have a symmetrical structure to be installed in the support plate 310 after being reversed up and down, and right and left. In the first arrangement, the first speaker module 330*a* may be a left speaker and the second speaker module 330*b* is a right speaker, and in the second arrangement, the first speaker module 330*a* is a right speaker and the second speaker module 330*b* is a left speaker.

Figure 21:
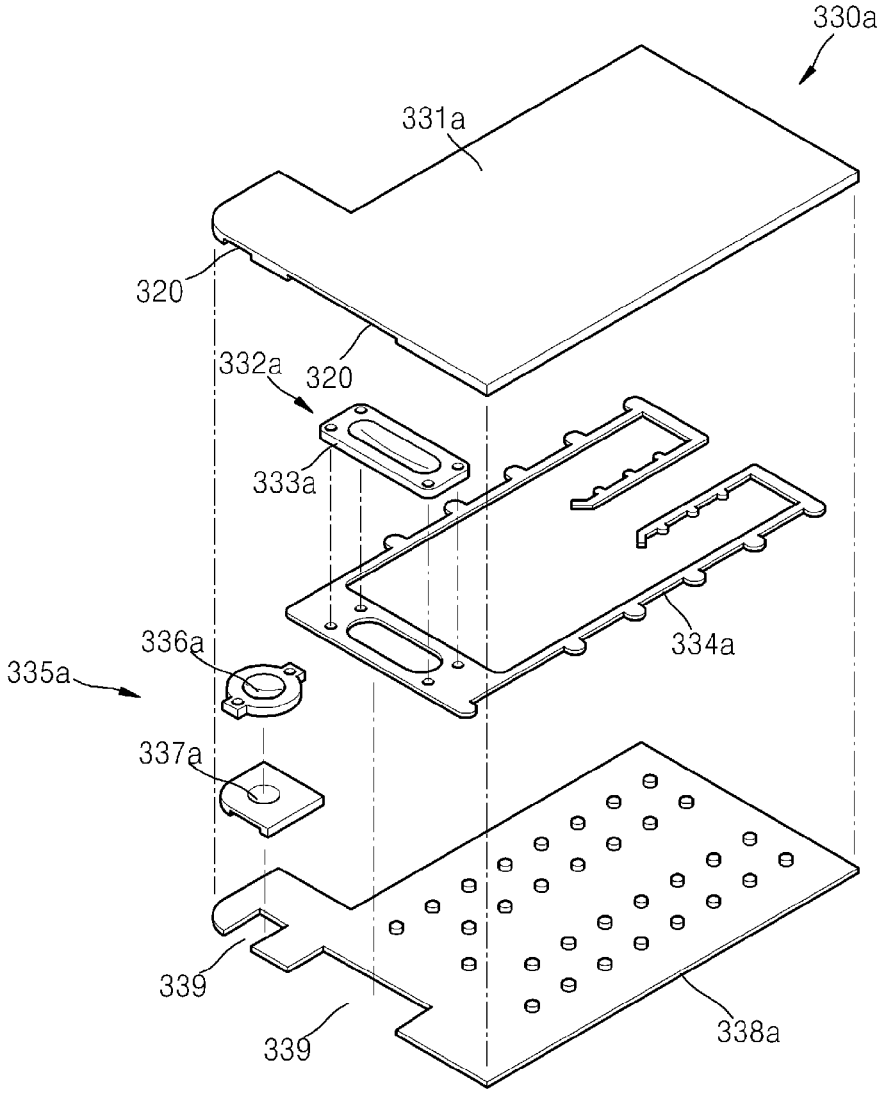
FIG. 21 is an exploded perspective view of a first speaker module of FIG. 20.

FIG. 21 is an exploded perspective view of the first speaker module 330*a* of FIG. 20. Referring to FIG. 21, the first speaker module 330*a* includes a woofer module 332*a* and a tweeter module 335*a* in a housing defined by an upper plate 331*a* and a lower plate 338*a*.

The first speaker module 330*a* includes a plurality of slits 320 for emitting sounds on a side surface thereof. The number of slits 320 may be 2 according to the woofer module 332*a* and the tweeter module 335*a*, so that the sounds are independently emitted. Each of the plurality of slits 120 is designed to have a thickness less than a wavelength of each of the sounds emitted through the plurality of slits 120 to serve as an acoustic center of the sound emission of the plurality of slits 120. Alternatively, the plurality of splits 320 may be disposed in the lower portion of the side surface of the first speaker module 330*a*. The plurality of slits 320 may satisfy a ground plane radiation condition when the sound plate 300 is in the first arrangement. Also, the lower plate 338*a* of the first speaker module 330*a* may have opened portions 339 to expose acoustic diaphragms 339 (shown in FIG. 22C) of the woofer 333*a* and the tweeter 336*a* to the outside of the first speaker module 330*a*. When the sound plate 300 is in the first arrangement, the opened portions 339 are covered by the lower plate 313 of the support plate 310. When the sound plate 300 is in the second arrangement, the first speaker module 330*a* may be turned over as will be described later to match the opened portion 311*b* of the support plate 310 of FIG. 20.

The woofer module 332*a* may include the woofer 333*a* and a frame 334*a*. The acoustic diaphragm 339 of the woofer 333*a* is installed to be disposed in the opened portion 339 of the lower plate 338*a*. One side of the frame 334*a* has a holder structure for fixing the woofer 333*a* and the other side of the frame 334*a* has a wall structure for sealing the upper plate 331*a* and lower plate 338*a*. A space sealed by the frame 334*a* between the upper plate 331*a* and the lower plate 338*a* operates as an enclosure for amplifying a low-pitched sound outputted from the woofer 333*a*. Because the upper plate 331*a* and the lower plate 338*a* of the first speaker module 330*a* are used as the enclosure, the ultra-slim sound plate 300 may be realized. Furthermore, the upper plate 331*a* and the lower plate 338*a* may easily prevent the sound plate 300 from self-vibrating by the low-pitched sound.

Also, the frame 334*a* serves as a support to maintain a state in which the upper plate 331*a* and the lower plate 338*a* of the first speaker module 330*a* are spaced from each other.

The tweeter module 335*a* may include the tweeter 336*a* and a tweeter holder 337*a*. The acoustic diaphragm 339 of the tweeter 336*a* is also installed to be placed in the opened portion 339 of the lower plate 338*a*. Furthermore, the acoustic diaphragm 339 of the tweeter 336*a* may be inclined toward an adjacent slit 320. Thus, radiation directions of the sounds may be inclined toward the slits 320.

The second speaker module 330*b* substantially has a structure that is bilaterally symmetrical to the first speaker module 330*a*, and thus detailed descriptions thereof are omitted herein.

FIGS. 22A through 22E are figures for illustrating an exemplary method of switching the electronic device of FIG. 18 from being arranged in the stand type to the hang type.

Figure 22A:
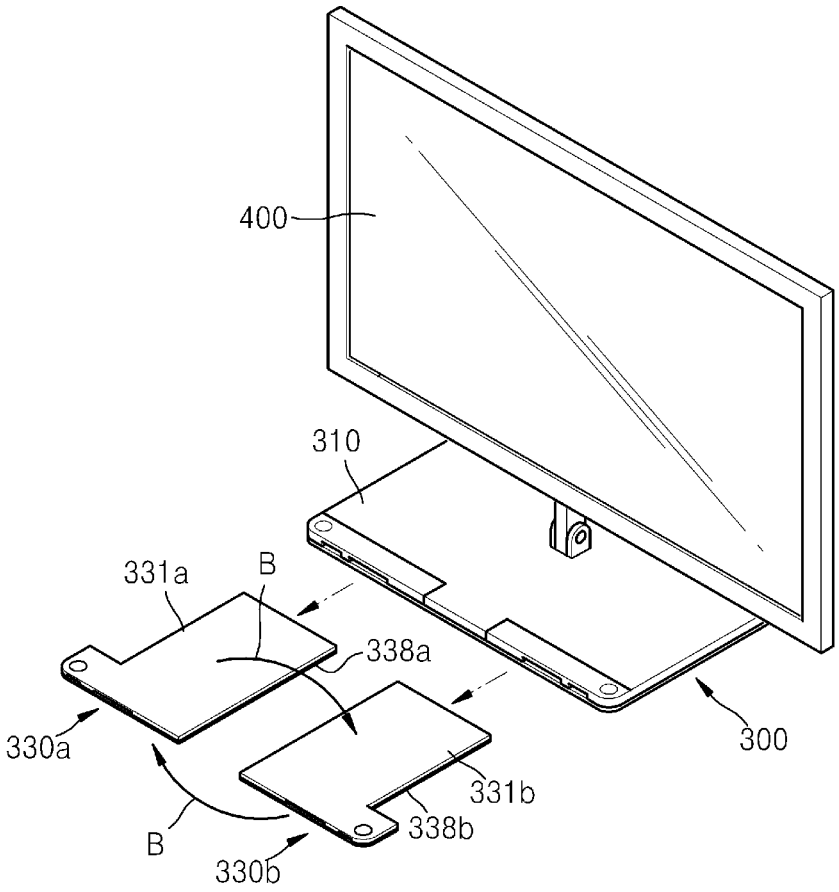
FIGS. 22A through 22E are diagrams for describing an exemplary method of switching the electronic device of FIG. 18 from being arranged in the stand type to the hang type.
Figure 22B:
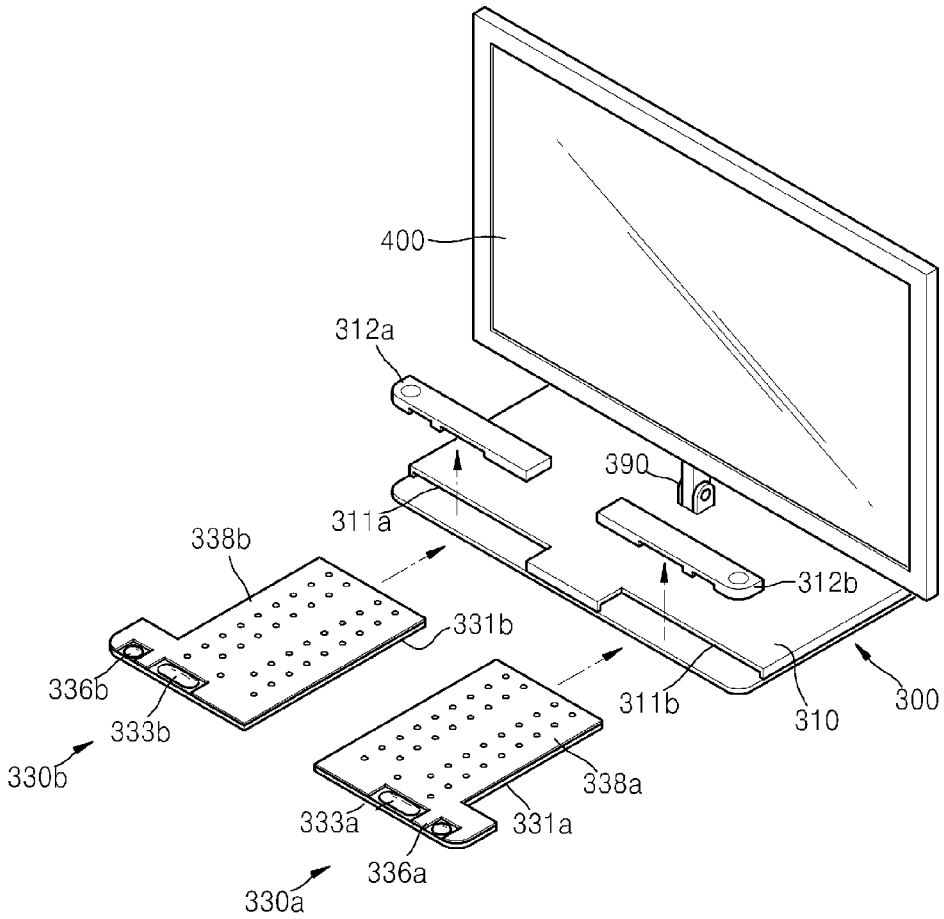
Figure 22C:
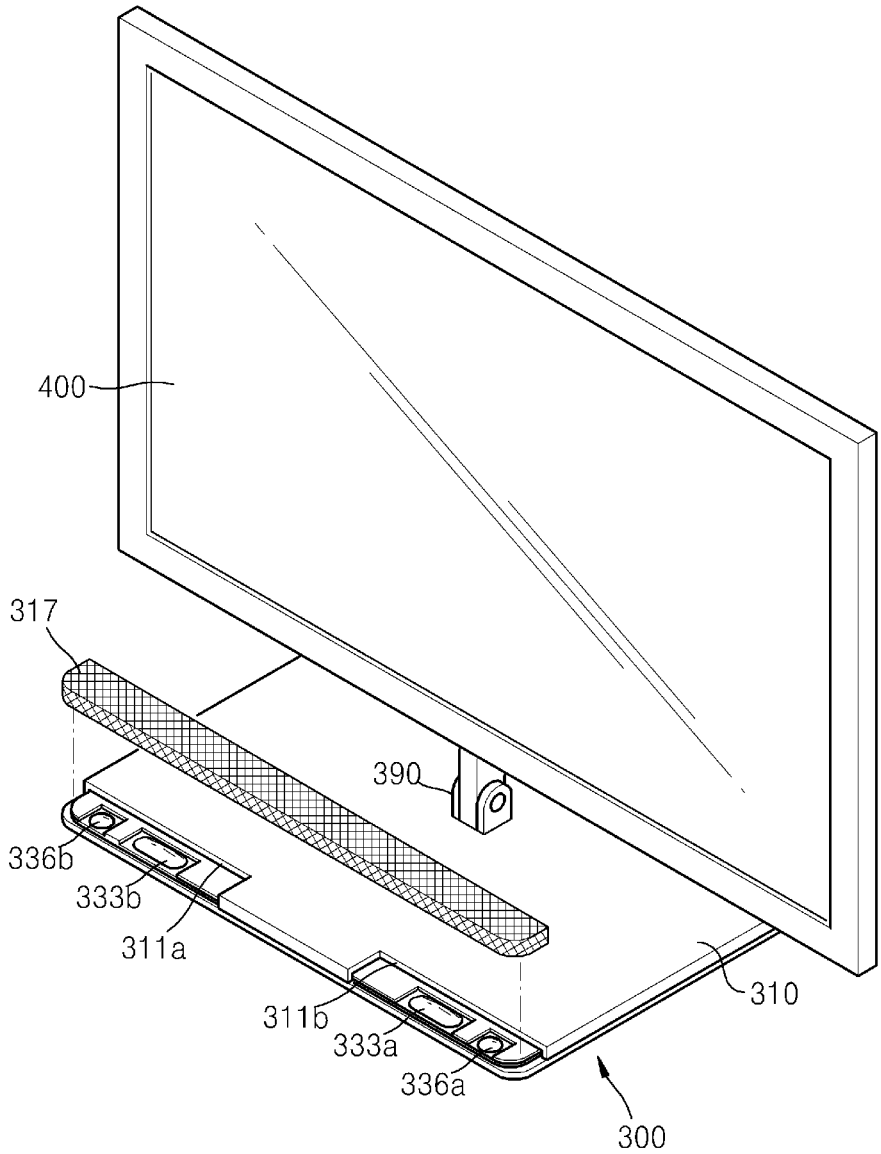
Figure 22D:
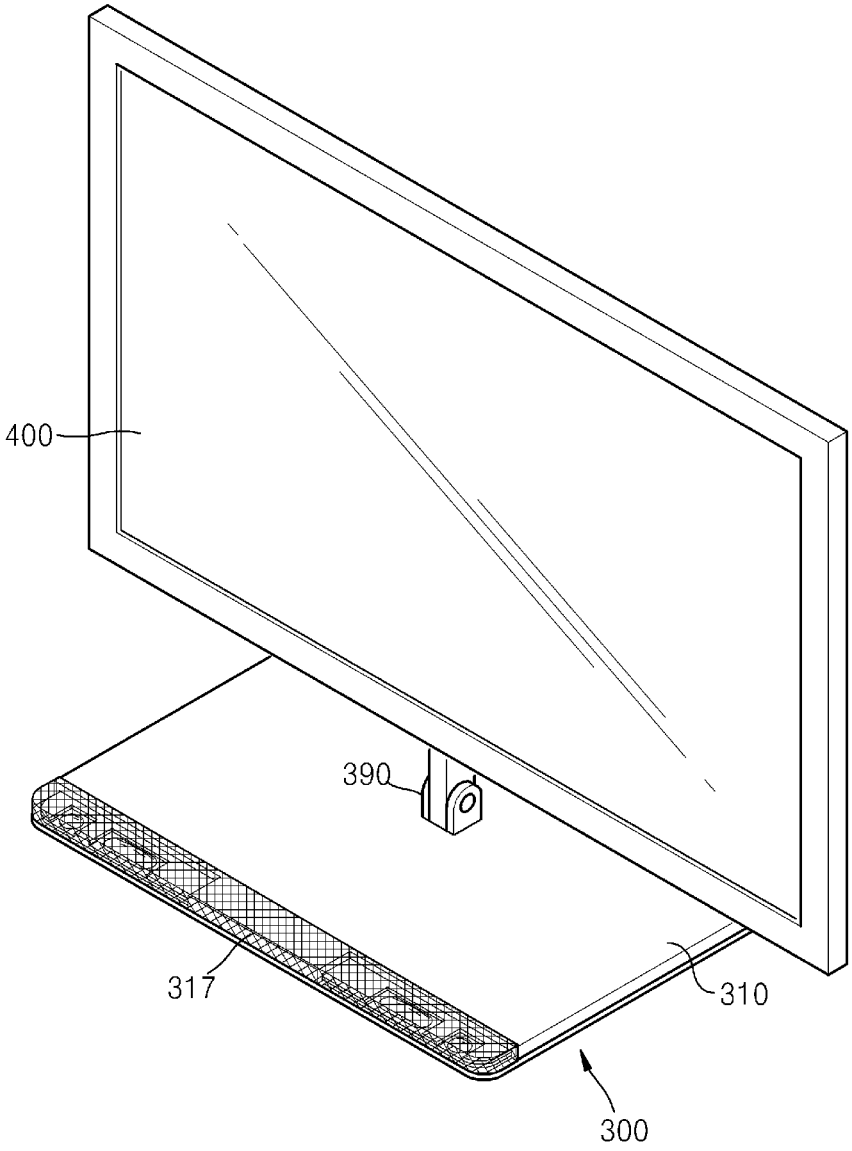
Figure 22E:
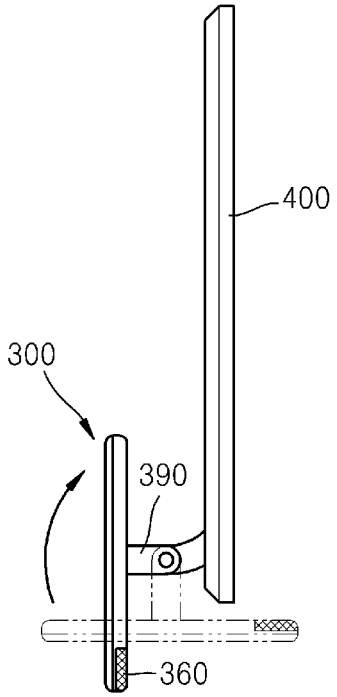

First, as shown in FIG. 22A, the first and second speaker modules 330*a* and 330*b* are taken out from the support plate 310 of the sound plate 300, in the electronic device in the stand type. Then, as shown in FIG. 22B, the slit covers 312*a* and 312*b* are separated from the support plate 310. Alternatively, the slit covers 312*a* and 312*b* may be separated before taking the first and second speaker modules 330*a* and 330*b* out from the support plate 310. Thereafter, the first and second speaker modules 330*a* and 330*b* are reversed right and left, and up and down as illustrated by the arrows B in FIG. 22A, and installed back in the support plate 310. In other words, the first speaker module 330*a* on the left side is turned over and installed on the right side of the support plate 310, and the second speaker module 330*b* on the right side is turned over and installed in the left side of the support plate 310. Accordingly, as shown in FIG. 22C, the acoustic diaphragms 339 of the woofers 333*a* and 333*b* and tweeters 336*a* and 336*b* are exposed to the outside the support plate 310 through the opened portions 311*a* and 311*b* of the support plate 310. The opened portions 311*a* and 311*b* of the support plate 310 is covered by the grill cover 317. FIG. 22D illustrates the sound plate 300 in the first arrangement covered by the grill cover 317. Then, as shown in FIG. 22E, the sound plate 300 is folded to the back of the main body 400 so as to switch the electronic device to the hang type. Furthermore, while switching the electronic device to the hang type, an adjustment value of an equalizer optimized with respect to the sound plate 300 when the electronic device is in the stand type is switched to an adjustment value optimized with respect to the hang type.

The electronic device according to the current embodiment of the present invention may be switched from the hang type to the stand type in reverse order of the method of FIGS. 22A through 22E.

The electronic device according to the above described embodiments has the following effects.

Since the main body is separated from the sound plate that is the speaker system of the main body, the main body may be ultra-slim.

Also, since the sound plate is a vibration source that is separated from the main body, the mechanical design of the main body may focus on overcoming thermal emission limitations.

Also, since the sound plate is a vibration source that is separated from the main body, the vibration limitation of the main body may be solved and the sound playback and articulation with respect to the low-pitched sound may be improved. Also, the sound pressure dip due to the path difference of the rear-side sound does not occur.

Also, when the sound plate is in the first arrangement, the sound plate may also serve as a stand. Also, since the self vibration of the sound plate may be restrained by a weight of the main body, the electronic device is strong against vibration.

Also, a sound quality similar to that of the front-firing type speaker may be secured, and by switching the equalizing mode corresponding to the first or second arrangement of the sound plate, the sound plate may expect superior low frequency extension and high frequency range recording having high articulation through adapted equalization.

Also, the electronic device may have optimum sweet spots at the center and the front surface thereof.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electronic device comprising:

a main body that performs a preset function;

a sound plate comprising at least one speaker unit which emits a sound according to an electric signal transmitted from the main body, and a flat plate which accommodates the at least one speaker unit; and a coupling unit which couples the main body and the sound plate, the main body and the sound plate being movable to one of a first arrangement and a second arrangement, wherein in the first arrangement the sound plate supports the main body from below the main body, and wherein in the second arrangement the sound plate is disposed at a rear of the main body, wherein in the first arrangement the sound plate is a slit-firing speaker system that emits a sound through at least one slit provided on a side surface of the flat plate, and in the second arrangement the sound plate is a front-firing speaker system that emits a sound through an opening provided on a front surface of the flat plate.

2. The electronic device of claim 1, wherein in the first arrangement the at least one slit is located in a lower portion of the side surface of the flat plate, and the sound emitted through the at least one slit in the first arrangement satisfies a ground plane radiation condition in which the sound is emitted upwardly from a ground at a solid angle of about 2Π.

3. The electronic device of claim 1, wherein the at least one speaker unit is disposed in such a way that an acoustic diaphragm faces the opening of the flat plate in the second arrangement.

4. The electronic device of claim 3, wherein at least a portion of the opening of the flat plate is located below the main body, in the second arrangement.

5. The electronic device of claim 1, wherein the main body comprises a display panel for displaying an image.

6. The electronic device of claim 1, further comprising an equalizer which processes the sound according to a first equalizing mode corresponding to the first arrangement and a second equalizing mode corresponding to the second arrangement.

7. The electronic device of claim 6, wherein the equalizer is a parametric equalizer.

8. The electronic device of claim 6, wherein the equalizer is mechanically or electrically switchable between the first equalizing mode and the second equalizing mode by a switch.

9. The electronic device of claim 1, wherein the coupling unit comprises:

a first coupling unit which detachably couples the sound plate to a bottom of the main body in the first arrangement; and a second coupling unit which detachably couples the sound plate to a rear of the main body in the second arrangement.

10. The electronic device of claim 9, wherein the flat plate comprises:

a first plate; and a second plate having the opening to which an acoustic diaphragm of the at least one speaker unit faces, wherein the opening of the second plate is covered by a slit cover in the first arrangement, and is covered by a grill cover through which air is flowable in the second arrangement.

11. The electronic device of claim 10, wherein the first coupling unit detachably couples the first plate of the flat plate to the bottom of the main body, and the second coupling unit detachably couples the second plate of the flat plate to the rear of the main body.

12. The electronic device of claim 10, wherein the at least one speaker unit comprises a woofer module and a tweeter module, which are arranged in parallel to one another in a space between the first plate and the second plate of the flat plate.

13. The electronic device of claim 12, wherein the woofer module comprises a frame which seals the first plate and the second plate of the flat plate to enclose the woofer module within the first and second plates.

14. The electronic device of claim 12, wherein the woofer module and the tweeter module are disposed in a pair at a left side and at a right side of the speaker module.

15. The electronic device of claim 1, wherein the coupling unit comprises a hinge that rotates the sound plate to a position below the main body in the first arrangement, and to a position at the rear of the main body in the second arrangement.

16. The electronic device of claim 15, wherein the at least one speaker unit is detachably installed in the flat plate.

17. The electronic device of claim 16, wherein the sound plate comprises a first speaker module and a second speaker module that accommodate the at least one speaker unit, and wherein the first speaker module and second speaker module are detachably installed respectively on the left side and right side of the flat plate, wherein the first speaker module and second speaker module are reversed up and down, and right and left relative to one another between the first arrangement and the second arrangement.

18. The electronic device of claim 17, wherein the at least one speaker unit comprises a woofer and a tweeter installed in each of the first speaker module and the second speaker module.

19. The electronic device of claim 17, wherein an acoustic diaphragm of the at least one speaker unit is exposed to an outside of the first speaker module and the second speaker module.

20. The electronic device of claim 19, wherein a portion of the first speaker module and the second speaker module which exposes the acoustic diagram of the at least one speaker unit is blocked by the flat plate in the first arrangement, and aligns with the opening of the flat plate in the second arrangement.

21. An electronic device comprising:

a main body that generates an electric signal;

a sound plate comprising a housing and at least one speaker unit disposed in the housing and which emits a sound according to the electric signal; and wherein the main body and the sound plate are attachable to one another according to a first arrangement which supports the main body from above or below the main body and a second arrangement which supports the main body from a rear of the main body, wherein in the first arrangement the sound plate emits the sound through a first opening provided on a first surface of the housing, and wherein in the second arrangement the sound plate emits the sound through a second opening provided on a second surface of the housing perpendicular to the first surface of the housing.

22. The electronic device of claim 21, wherein the first opening is a slit.

23. The electronic device of claim 21, wherein the slit is disposed at a side of the first surface of the housing that is away from the main body in the first arrangement.

24. The electronic device of claim 21, wherein the housing of the sound plate extends along a plane that is perpendicular to the main body in the first arrangement, and the housing of the sound plate extends along a plane that is parallel to the main body in the second arrangement.

25. The electronic device of claim 6, wherein the equalizer further processes the sound according to frequency bands.

* * * * *